US007470096B2

(12) United States Patent
Morrish

(10) Patent No.: US 7,470,096 B2
(45) Date of Patent: Dec. 30, 2008

(54) DRAWING PIN

(76) Inventor: David Morrish, 5 Lake Close, Churcham, Gloucestershire GL2 8BS (GB)

( * ) Notice: Subject to any disclaimer, the term of this patent is extended or adjusted under 35 U.S.C. 154(b) by 0 days.

(21) Appl. No.: 10/558,696

(22) PCT Filed: May 28, 2004

(86) PCT No.: PCT/GB2004/002309

§ 371 (c)(1),
(2), (4) Date: Jan. 29, 2007

(87) PCT Pub. No.: WO2004/106088

PCT Pub. Date: Dec. 9, 2004

(65) Prior Publication Data

US 2007/0139866 A1 Jun. 21, 2007

(30) Foreign Application Priority Data

May 30, 2003 (GB) ..... 0312458.3

(51) Int. Cl.
*B43M 15/00* (2006.01)

(52) U.S. Cl. ..... 411/439; 411/445; 411/481; 206/338

(58) Field of Classification Search ..... 411/439, 411/442, 445, 479, 481, 482, 489, 498; 206/338
See application file for complete search history.

(56) References Cited

U.S. PATENT DOCUMENTS

| | | | | |
|---|---|---|---|---|
| 24,326 | A * | 6/1859 | Hyslop | 122/122 |
| 226,426 | A * | 4/1880 | Paull | 72/324 |
| 797,494 | A * | 8/1905 | Chase | 411/481 |
| 861,188 | A * | 7/1907 | Jones | 411/446 |
| 1,604,815 | A * | 10/1926 | Fedderman | 411/439 |
| 1,912,099 | A * | 5/1933 | Rosenberg | 411/453 |
| 2,366,510 | A * | 1/1945 | Frank | 411/445 |
| 2,623,431 | A | 12/1952 | Scheurmann | |
| 2,689,645 | A * | 9/1954 | Greene, Jr. | 206/338 |
| 2,948,056 | A * | 8/1960 | Muenchinger | 206/338 |
| 3,492,907 | A * | 2/1970 | Hauck | 411/443 |
| 3,528,466 | A * | 9/1970 | Tracy | 81/431 |
| 3,713,246 | A * | 1/1973 | Kilroy, Jr. | 446/86 |
| 4,525,115 | A | 6/1985 | Garner, Sr. | |
| 6,168,362 | B1 * | 1/2001 | Tucker et al. | 411/442 |

FOREIGN PATENT DOCUMENTS

| | | |
|---|---|---|
| DE | 348051 | 1/1922 |
| DE | 810360 | 8/1951 |
| DE | 1561933 | 4/1970 |
| GB | 163664 | 8/1921 |
| GB | 587843 | 5/1947 |
| GB | 697513 | 9/1953 |
| JP | 8-002189 | 1/1996 |
| JP | 2001-096991 | 4/2001 |

* cited by examiner

*Primary Examiner*—Flemming Saether
(74) *Attorney, Agent, or Firm*—Clark & Brody

(57) ABSTRACT

A drawing pin comprises a head portion and a spike, the head portion having an aperture therein in order to receive the spike of a subsequent drawing pin.

9 Claims, 2 Drawing Sheets

DRAWING PIN

FIELD OF THE INVENTION

This invention relates to a drawing pin and a dispenser to release the pin into a conventional drawing pin board or other receiving substrate.

BACKGROUND ART

Drawing pins are used extensively to fasten paper or other materials to a board by piercing the material and becoming embedded in the board. There are numerous types of drawing pins known from the conventional metal drawing pin with a short spike and a broad flat head, to pins with a range of sizes and shaped heads moulded from plastics material.

Drawing pins are usually supplied in a box wherein the user is required to pick each pin out of the box individually before use. This can be time consuming as the pins are often difficult to grip and a certain amount of manual dexterity is required to pick up a pin and apply it to the board.

It is therefore an object of the present invention to provide a drawing pin and dispenser in order to overcome the problems as mentioned above.

SUMMARY OF THE INVENTION

In one aspect the invention provides a drawing pin comprising a head portion and a spike, the head portion having an aperture therein in order to receive the spike of a subsequent drawing pin.

Pins according to the invention may be provided stacked or nested together, whereby it is relatively easy to remove an end-most pin and apply it to a board.

The head portion of a pin according to the invention may be formed from any suitable material, preferably a plastics material.

The head portion of the pin may comprise upper and lower regions; preferably the upper and lower regions of the head portion are integrally formed from the same material. The lower region is of a reduced diameter compared to that of the upper region, whereby the upper region is spaced from the surface of the board in use, to facilitate gripping and withdrawal from the board. The aperture formed in the upper region of the head may extend into the lower region of the head.

Preferably the head portion and the spike are integrally formed. The spike of the drawing pin may be hollow and attached to the head of the pin so as to be in communication with the aperture and so as to receive the spike of a subsequent pin. In this case, the spike is conical and the internal cavity thereof is also conical.

The spike may further comprise a track in the form of a groove or a ridge in order to hold the pin in the receiving substrate more securely. The ridge or groove is preferably in the form a helix. The track may have a V-shaped, square or curved profile in section and preferably has a width of about 0.10 mm.

In another aspect the invention provides a stack of drawing pins of the type described in the first aspect.

In yet another aspect, the invention provides a dispenser apparatus for drawing pins of the type described, the apparatus comprising a magazine for holding a quantity of drawing pins in a nested or stacked configuration, means for urging the pins towards the front or application end of the apparatus and means for applying pressure to the pin to impel the pin from the magazine into a receiving substrate.

Preferably, the apparatus also includes means for retaining the stack in the magazine and means for separating the forward most pin from the remainder of the pins in the magazine and placing the pin in a pre-application position.

The magazine preferably comprises a tube having an internal diameter for receiving the pins in a stable stack while allowing the stack to be advanced towards the front end of the apparatus by the urging means. The urging means may comprise a resiliently-biassed pressure plate operatively connected to a closure member at the rear end of the apparatus. The retention and separation means may be manually-operable separately from the pressure-application means or may be automatically activable as application pressure is applied. In a separately-operable embodiment, the retention and separation means may comprise a pair of jaws which are pivotably mounted to an external casing or housing containing the magazine for movement of the front or distal ends between a pin-engagement position and a pin-release position, pivoting movement being manually effected preferably by the application of force to the rear or proximal ends of the jaws. The front or distal ends of the jaws may comprise means to grip the edge of the pin head or means to extend under the pin head when the jaws are in the closed or pin-engagement position and the rear or proximal ends of the jaws are preferably on the far or remote side of the pivot axis from the front ends, whereby a manual squeezing action on the rear ends will open the jaws and allow the end pin of the stack to assume the pre-application position. The pin is then retained in the pre-application position until pressure is applied thereto, preferably by direct manual force to the apparatus so that the spike becomes embedded in the substrate and is retained therein as the apparatus is withdrawn. Preferably, the apparatus includes means temporarily to hold the pin in the pre-application position pending embedding in the substrate; such means may, for example, comprise one or more resilient flaps or leaves which extend partially across the aperture at the application end of the apparatus to retain the pin head while allowing the spike to protrude through, the flaps or leaves yielding resiliently to allow the apparatus to be withdrawn from the substrate while leaving the pin embedded therein.

BRIEF DESCRIPTION OF THE DRAWINGS

Embodiments of the invention will now be described by way of example with reference to the accompanying drawings, in which.

DESCRIPTION OF THE PREFERRED EMBODIMENTS

Figure 1:
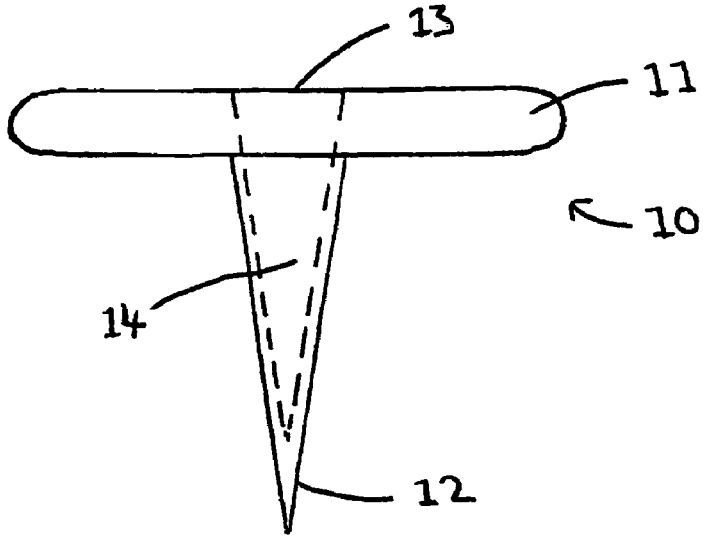
FIG. 1 is a side elevation of a first pin.

With reference to FIG. 1, a drawing pin shown generally at 10 has a head portion 11 and a hollow conical spike 12 wherein, the head 11 is formed with an aperture 13 which is in communication with the hollow spike 12 to produce a cavity 14. In use, the cavity 14 receives the spike of a subsequent drawing pin.

Figure 2:
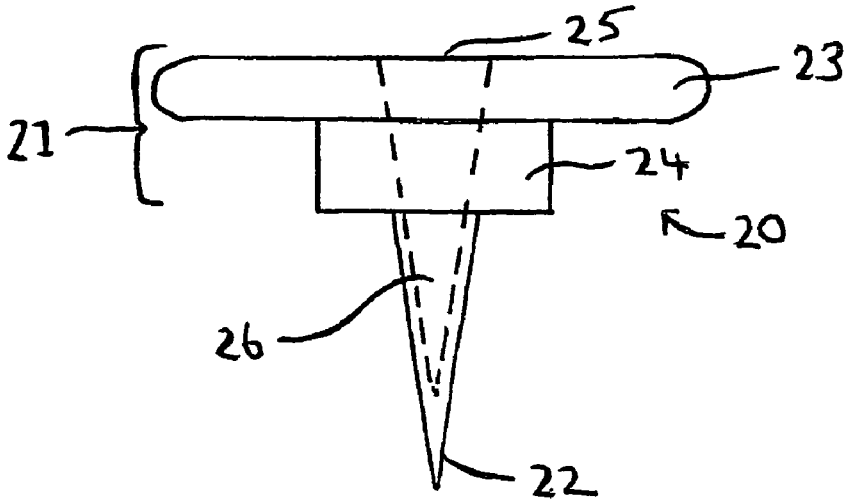
FIG. 2 is a side elevation of a second pin.

With reference to FIG. 2, a drawing pin shown generally at 20 has a head portion 21 and a hollow conical spike 22. The head position 21 has upper and lower regions, wherein the lower region 24 has a reduced diameter when compared with the upper region 23. An aperture 25 is formed in the upper and lower head portion and is in communication with the hollow spike 12 to produce a cavity 26 which, in use, receives the spike of a subsequent drawing pin.

Figure 3:
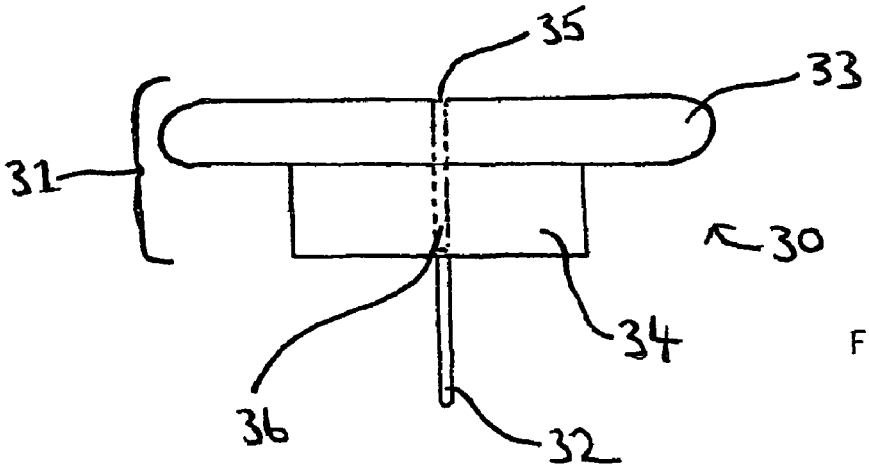
FIG. 3 is a side elevation of a third pin.

With reference to FIG. 3, a drawing pin shown generally at 30 has a head portion 31 and a cylindrical spike 32. The head portion 31 has upper and lower regions wherein, the lower region 34 has a reduced diameter when compared with the upper region 33. An aperture 35 is formed in the upper and lower head portion to produce a cavity 36 which, in use, receives the spike of a subsequent drawing pin.

In each of the embodiments shown in FIGS. 1 to 3 a number of pins can be stacked together in order for distribution for use with or without a dispenser.

Figure 4:
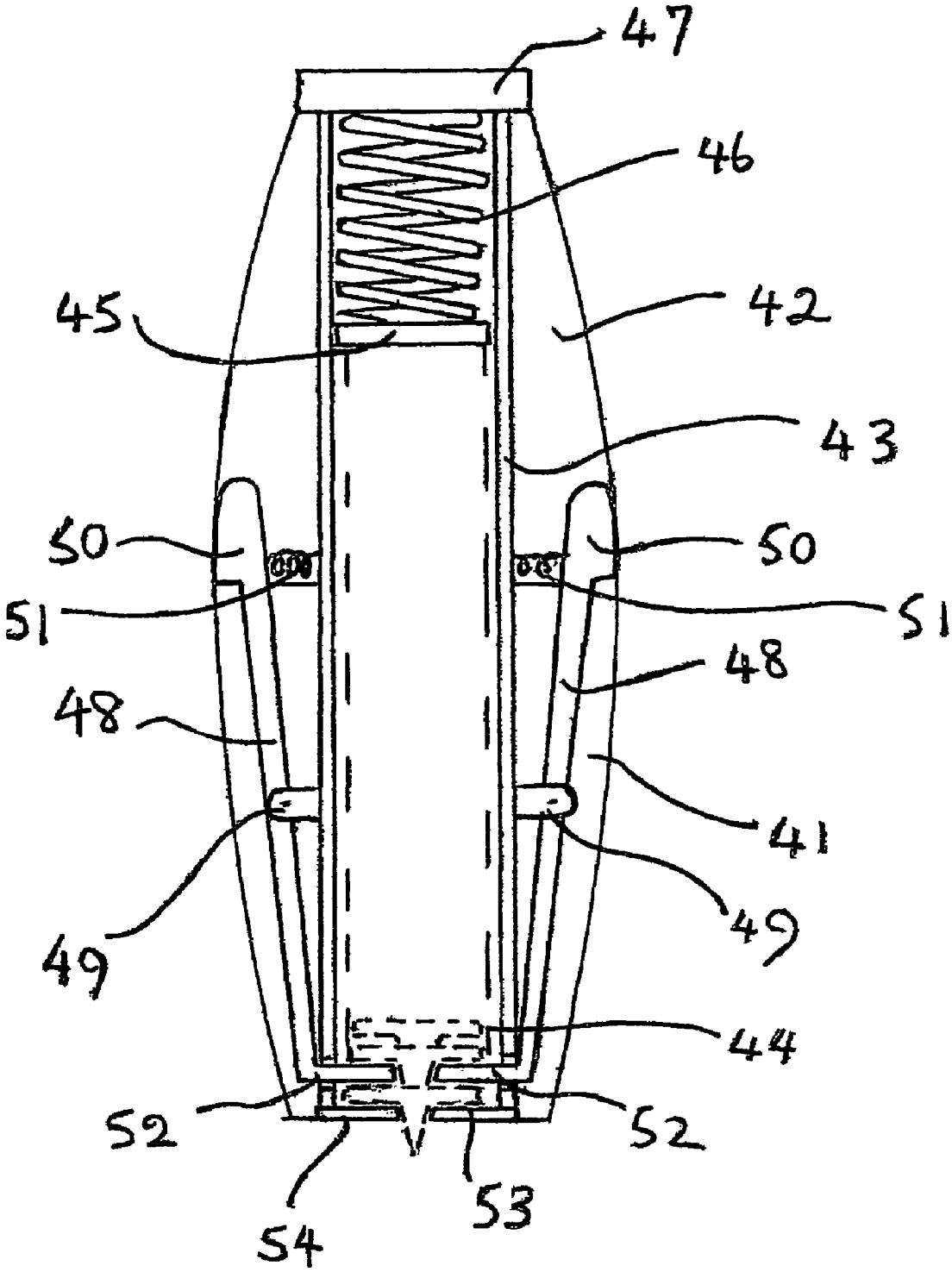
FIG. 4 is a schematic view of a dispenser for holding a stack of pins and applying them individually to a substrate.

With reference to FIG. 4, the dispenser consists of a two-part housing 41, 42 containing a central cylindrical magazine 43. The magazine holds an array 44 of drawing pins of the type described in a nested or stacked arrangement, the array being urged towards the lower end of the magazine by virtue of pressure plate 45 connected to a helical spring 46 itself connected to a closure member 47 at the upper end of the magazine.

A pair of lever arms 48, each being pivoted at 49, can be manually squeezed together at their upper ends 50 against a resilient force exerted by springs 51. At their lower ends, the arms terminate in inwardly-directed fingers 52 which, in the closed position as shown, define a gap between them to receive the spike of a drawing pin, the head thereof being retained by the fingers 52. On squeezing together the arms 50, the lower ends thereof move outwardly, thereby allowing the pin to pass through to assume the position as represented by pin 53, under pressure exerted by spring 46, ready to be applied to a substrate. The pin 53 is temporarily restrained in the pre-application position, as shown, by resilient leaves 54 defining a central aperture to receive the spike.

In use, the apparatus is applied to a substrate so that the spike of pin 53 becomes embedded therein, the resilient leaves 54 yielding on withdrawal of the apparatus to leave the pin in place in the substrate. The next pin may then be allowed to assume the pre-application position by operation of lever arms 50.

The invention claimed is:

1. A drawing pin comprising a head portion, a spike, and an aperture, wherein the head portion comprises upper and lower regions, the lower region being of a reduced diameter compared to that of the upper region, and the aperture is formed in the upper region of the head portion, extends into the lower region of the head portion, and terminates at a bottom face located in the lower region of the head portion, the aperture having a shape generally corresponding to that of the spike adapted to receive the spike of another such drawing pin.

2. A drawing pin according to claim 1, in which the head portion is formed from a plastics material.

3. A drawing pin according to claim 2, in which the upper and lower regions of the head portion are integrally formed from the same material.

4. A drawing pin according to claim 2, in which the head portion and the spike are integrally formed.

5. A stacked or nested array of drawing pins according to claim 2.

6. A drawing pin according to claim 1, in which the upper and lower regions of the head portion are integrally formed from the same material.

7. A drawing pin according to claim 1, in which the head portion and the spike are integrally formed.

8. A stacked or nested array of drawing pins according to claim 7.

9. A stacked or nested array of drawing pins according to claim 1.

* * * * *